US005526955A

United States Patent [19]

Windorski et al.

[11] Patent Number: 5,526,955

[45] Date of Patent: Jun. 18, 1996

[54] ASSEMBLY INCLUDING REFILLABLE COMPACT SHEET DISPENSER

[75] Inventors: David C. Windorski, Woodbury; James A. Wilson, North St. Paul, both of Minn.

[73] Assignee: Minnesota Mining and Manufacturing Company, St. Paul, Minn.

[21] Appl. No.: 306,102

[22] Filed: Sep. 14, 1994

[51] Int. Cl.[6] ..... B65H 1/04

[52] U.S. Cl. ..... 221/34; 221/33; 221/45; 221/47; 221/62; 221/92; 221/286; 221/306

[58] Field of Search ..... 221/33, 34, 45, 221/47, 50, 61, 62, 63, 92, 123, 124, 130, 131, 155, 281, 282, 286, 306, 312 C

[56] References Cited

U.S. PATENT DOCUMENTS

| | | | |
|---|---|---|---|
| 1,712,479 | 5/1929 | Allen et al. | 221/62 X |
| 2,195,727 | 4/1940 | Jensen | 221/306 X |
| 2,276,463 | 3/1942 | Buxton et al. | 281/19 |
| 2,818,662 | 1/1958 | Payne et al. | 35/66 |
| 3,606,080 | 9/1971 | Lynch et al. | 221/63 |
| 3,764,167 | 10/1973 | Longarzo | 281/115 |
| 4,134,519 | 1/1979 | Barnett et al. | 221/62 X |
| 4,562,938 | 1/1986 | Loder | 221/46 |
| 4,586,630 | 5/1986 | Loder | 221/46 |
| 4,586,631 | 5/1986 | Loder | 221/61 X |
| 4,653,666 | 3/1987 | Mertens | 221/45 |
| 4,781,306 | 11/1988 | Smith | 221/33 |
| 4,907,825 | 3/1990 | Miles et al. | 281/51 |
| 5,080,255 | 1/1992 | Windorski | 221/45 |
| 5,086,946 | 2/1992 | Blackwell et al. | 221/45 |
| 5,143,250 | 9/1992 | Freitag | 221/61 X |
| 5,158,205 | 10/1992 | Bodziak et al. | 221/51 |
| 5,165,570 | 11/1992 | Windorski et al. | 221/46 |
| 5,167,346 | 12/1992 | Bodziak | 221/63 |
| 5,174,607 | 12/1992 | Hill | 281/45 |
| 5,358,141 | 10/1994 | Carlson et al. | 221/185 |

OTHER PUBLICATIONS

U.S. Patent Application Serial No. 08/263,601 filed Jun. 21, 1994.

International Search Report PCT/US95/10011.

*Primary Examiner*—William E. Terrell

*Assistant Examiner*—Dean A. Reichard

*Attorney, Agent, or Firm*—Gary L. Griswold; Walter N. Kirn; William L. Huebsch

[57] ABSTRACT

Described is a dispenser for sheets received in a cavity in the dispenser that are pulled through an outlet opening in a top wall of the dispenser. The dispenser has access openings that afford inspection of the number of sheets remaining in the dispenser and facilitate engagement of a persons finger with the end portion of one of the sheets that projects through the outlet opening; a cover for the top wall when the dispenser is not in use; and separable portions that allow sheets to be positioned in the cavity. The dispenser can be included in an assembly further including a support member along which the dispenser is releasably attached, which support member can support one or more such dispensers together with dispensers for other items such as tape flags.

11 Claims, 5 Drawing Sheets

ASSEMBLY INCLUDING REFILLABLE COMPACT SHEET DISPENSER

TECHNICAL FIELD

The present invention relates generally to dispensers for pressure sensitive adhesive coated sheets and retaining means to which such dispensers can be attached to releasably retain them at predetermined locations.

BACKGROUND ART

Refillable dispensers adapted to dispense pressure sensitive adhesive coated sheets are known, as are retaining means to which such dispensers can be attached to releasably retain them at predetermined locations. U.S. Pat. No. 5,086,946 issued Feb. 11, 1992, (the content whereof is incorporated herein by reference) describes such a dispenser, and includes a discussion of the background art relating to such dispensers; whereas another such refillable dispenser is described in U.S. Pat. No. 5,299,712 (the content whereof is also incorporated herein by reference).

DISCLOSURE OF THE INVENTION

The present invention provides an assembly including an improved compact refillable dispenser from which sheets in a stack of sheets of the type described in U.S. Pat. Nos. 4,781,306 or 4,907,825 can be dispensed, together with a support member to which one or more of the dispensers can be attached, and by which the dispenser can be positioned at predetermined locations.

According to the present invention there is provided an assembly comprising a dispenser for dispensing flexible sheets from a stack of sheets disposed one on top of another, which dispenser comprises walls having inner surfaces defining a cavity adapted to receive the stack. The walls include a top wall and opposite side walls depending from and flanking the top wall. The top wall has an outlet opening for the cavity between its inner and outer surfaces through which individual sheets from the stack in the cavity may be manually withdrawn, which outlet opening is elongate in a direction parallel to the side walls. Also, the top and side walls have through access openings flanking the outlet opening, each of which access openings is adapted to afford inspection of the number of sheets remaining in the dispenser and to facilitate engagement of a persons finger with the end portion of one of the sheets that projects through the outlet opening and lays along the outer surface of the top wall and over the access opening.

The dispenser further includes first and second end walls extending between the adjacent ends of the side walls, and a cover mounted by hinge means on the second end wall for movement between a closed position overlaying the outer surface of the top wall, and an open position spaced from that outer surface; which hinge means can include means for manually detaching the cover from and subsequently reattaching the cover to the second end wall.

Preferably, the dispenser includes a first portion including the top wall, the side walls and the second end wall; a second portion including the first end wall; means mounting the second portion on the first portion for movement between a closed position with the first end wall extending between the ends of the side walls opposite the second end wall, and an open position with the first end wall spaced from those ends of the end walls to afford access to the cavity so that a stack of sheets may be inserted therein; and means for releasably retaining the first and second portions in the closed position.

Also, the assembly can further include a support member, and attachment means for releasably attaching the dispenser to the support member with a bottom wall of the dispenser along a front surface of the support member, which attachment means can be provided by the dispenser having opposite outwardly projecting ledges centered along its end walls and disposed generally parallel with its bottom wall, and the support member including a ridge projecting above the front surface and defining a recess adapted to receive one of the ledges, and a latch portion spaced along the front surface from the ridge and having a recess adapted to receive the other one of the ledges. The latch portion is resiliently elastically bendable to a release position sufficiently spaced from the ridge to afford movement of the ledges into the recesses from a normal retaining position with the latch member in a position to releasably retain the ledges in the recesses, and the latch portion includes a manually engageable projection affording manual movement of the latch portion from the retaining position to the release position. Additionally, at least one of the ledges on the dispenser and the latch portion can include cam surfaces adapted for engagement to move the latch portion to the release position upon engagement of the other of the ledges in the recess in the ridge and movement of that one ledge toward the recess in the latch portion.

The support member in the assembly can include means for releasably attaching a plurality of the dispensers to the support member in side by side relationship, each in the manner described above, which support member can also releasably attach other types of dispensers adjacent the dispensers described above, such as the dispensing package for a product currently sold by Minnesota Mining and Manufacturing Company, St. Paul, Minn., under the trade designation "Post-it" Brand Tape Flags which, when so attached, then allows a user of the assembly to either withdraw sheets (which can be paper notes) from one of the dispensers described above, or to withdraw tape flags from one of those dispensers for tape flags.

BRIEF DESCRIPTION OF THE DRAWING

The present invention will be further described with reference to the accompanying drawing wherein like reference numerals refer to like parts in the several views, and wherein.

DETAILED DESCRIPTION

Figure 1:
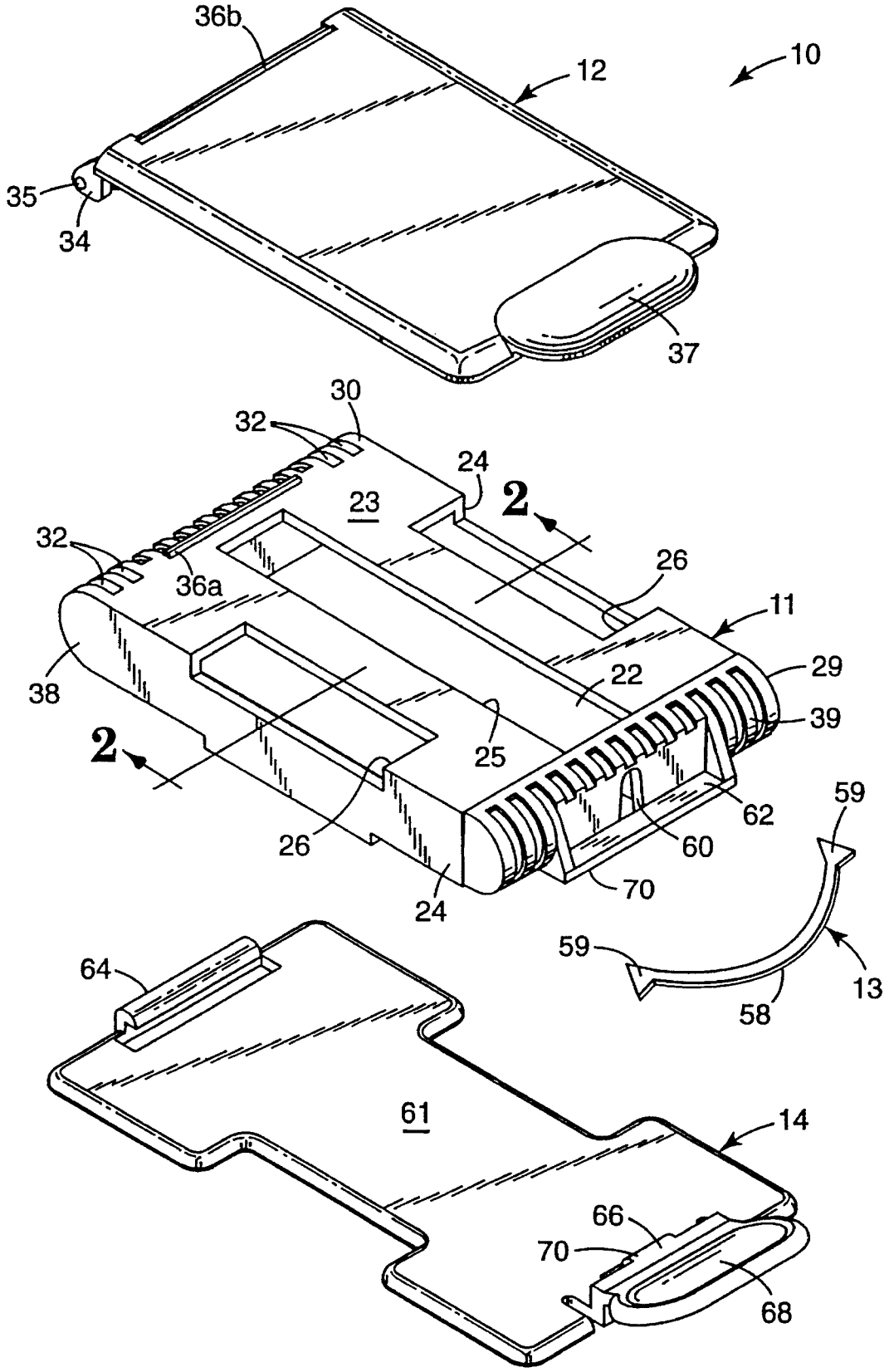
FIG. 1 is an exploded perspective view of an assembly according to the present invention.

Referring now to the drawing, in FIG. 1 there is shown an assembly 10 according to the present invention that can comprise a dispenser 11, and can further include a removable cover 12 for the dispenser 11, a removable attachment strap 13 for the dispenser 11, and/or a support member 14 on which the dispenser 11 can be removably attached.

Figure 2:
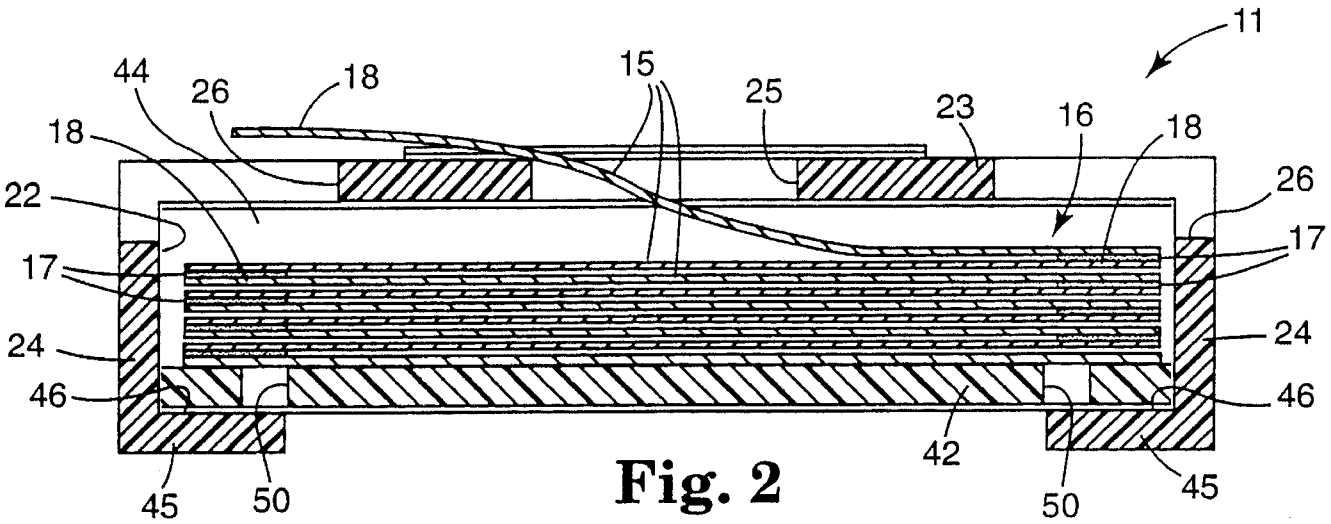
FIG. 2 is a cross sectional view taken approximately along line 2—2 of FIG. 1 that illustrates a stack of sheets in a dispenser included in the assembly of FIG. 1.

As is illustrated in FIG. 2, the dispenser 11 can be used for dispensing adhesive-bearing flexible paper sheets 15 from a coherent stack 16 of those sheets 15 (e.g., from a stack of sheets generally of the type described in U.S. Pat. No. 4,416,392, the content whereof describing the sheets and the way they are disposed in a stack is incorporated herein by reference). On an underside or second surface of each of the adhesive-bearing paper sheets 15 is a layer or narrow band 17 of pressure-sensitive adhesive adjacent a second end of the sheet, with the bands 17 of adhesive on successive sheets at opposite sides of the stack 16. Both first and second surfaces of each of the adhesive-bearing paper sheets 15 are free from adhesive along a major first end portion 18 opposite their second ends. Alternatively, the stack 16 of sheets 15 could be one or more stacks of sheets of the type described in U.S. Pat. No. 4,907,825 (i.e., the stack of sheets sold in a dispenser under the trade designation "Post-it" (T.M.) Tape Flags) the content of which U.S. Pat. No. 4,907,825 is incorporated herein by reference.

The dispenser 11 comprises walls molded of polymeric material and having inner surfaces defining a cavity 22 which is adapted to receive the stack 16 of sheets 15. Those walls include a top wall 23 and opposite side walls 24 depending from and flanking the top wall 23, and opposite parallel first and second end walls 29 and 30 extending between the adjacent ends of the side walls 24. The top wall 23 has an outlet opening 25 for the cavity 22 between its inner and outer surfaces, through which outlet opening 25 individual sheets 15 from the stack 16 in the cavity 22 may be manually withdrawn. That outlet opening 25 is elongate in a direction parallel to the side walls 24. The first end portion 18 of the uppermost of the dispensable sheets 15 extends through the outlet opening 25 and lays along the outer surface of the top wall 23, where that first end portion 18 may be grasped to withdraw the sheet from the dispenser 11. The dispenser is intended for a stack 16 of about 50 or less sheets 15, with the cavity having a height only slightly greater than the height of the stack 16; and the width of the slot measured at a right angle to the side walls 24 is in the range of about 0.5 to 1.8 centimeter (0.2 to 0.7 inch) and is preferably about 1.0 centimeter (0.4 inch) wide which allows the sheets 15 from such a stack 16 to be individually withdrawn rather easily, while still causing each withdrawn sheet 11 to separate from the sheet 11 beneath it in the stack 16 as it is withdrawn. The top and side walls 23 and 24 also have through access openings 26 flanking the outlet opening 25. The access openings 26 (in addition to facilitating molding of the dispenser 11) are each adapted to afford inspection of the number of sheets 15 remaining in the dispenser 11 and to facilitate engagement of a persons finger with the first end portion 18 of one of the sheets 15 that projects through the outlet opening 25 and lays along the outer surface of the top wall 23 over one of the access openings 26.

The assembly, optionally, can include the cover 12 that is adapted to overlay the outer surface of the top wall 23 together with hinge means mounting the cover 12 on the second end wall 30 for movement between a closed position overlaying the outer surface of the top wall 23, and an open position spaced from the top wall 23.

The hinge means mounting the cover 12 on the second end wall 30 for movement between its closed and open positions also include detaching means for manually detaching the cover 12 from and subsequently re-attaching the cover 12 to the second end wall 30.

Those hinge and detaching means are provided by spaced parts of the second end wall 30 defining two pairs of spaced parallel grooves 32 in the second end wall 30 extending generally parallel to the side walls 24 and defining a pair of generally semi-spherical opposed sockets 33 recessed in those parts from the outer groove 32 in each pair; and by the cover 12 having two pairs of spaced parallel projecting plate-like portions 34 spaced and adapted to be positioned in the grooves 32 in the second end wall 30, and having semi-spherical projections 35 projecting from opposite sides of the two outermost of the plate-like portions 34 that are received in the sockets 33 when the cover 12 is engaged with the second end wall 30. When the cover 12 is engaged with the second end wall 30 the semi-spherical projections 35 provide pivot members about which the cover 12 moves between its open and closed positions. The center plate like part defining each set of two grooves 32 is sufficiently resiliently flexible to allow the semi-spherical projections 35 to be pulled from within the sockets 33 when the cover 12 is open to separate or detach the cover 12 from the second end wall 30, and to subsequently reposition the semi-spherical projections 35 within the sockets 33 to re-attach the cover 12 to the second end wall 30. The cover 12 is releasably retained in its closed position by a retaining ridge **36*a* projecting from the second end wall 30 which releasably engages a slot 36*b* in the cover 12. The cover 12 also has a manually engageable projection 37 that facilitates opening and closing the cover 12, and has a planar inner surface to which a sheet or sheets 15 may be adhered for storage after they are removed from the stack 16**.

Figure 7:
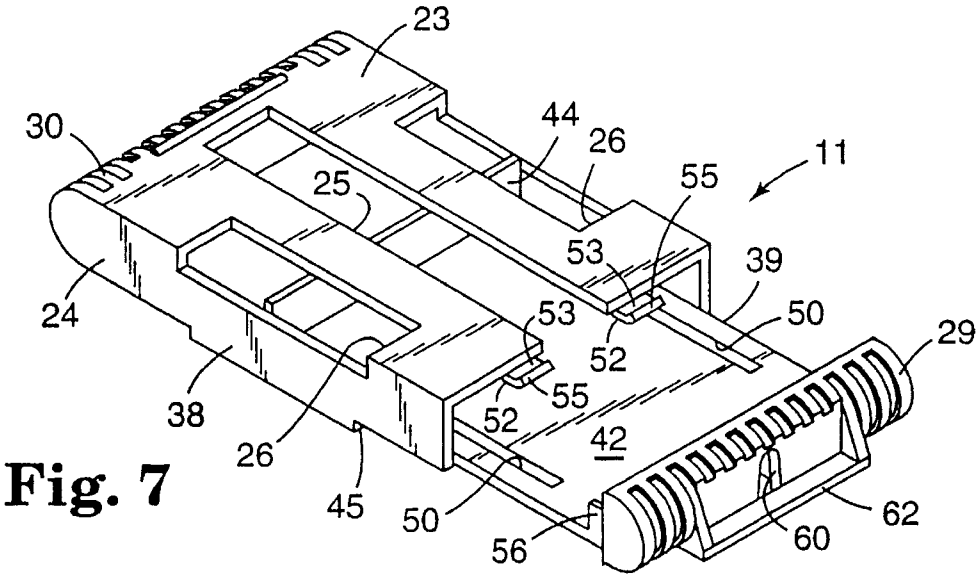
FIG. 7 is a perspective view of the dispenser showing first and second portions of the dispenser in an open position.
Figure 3:
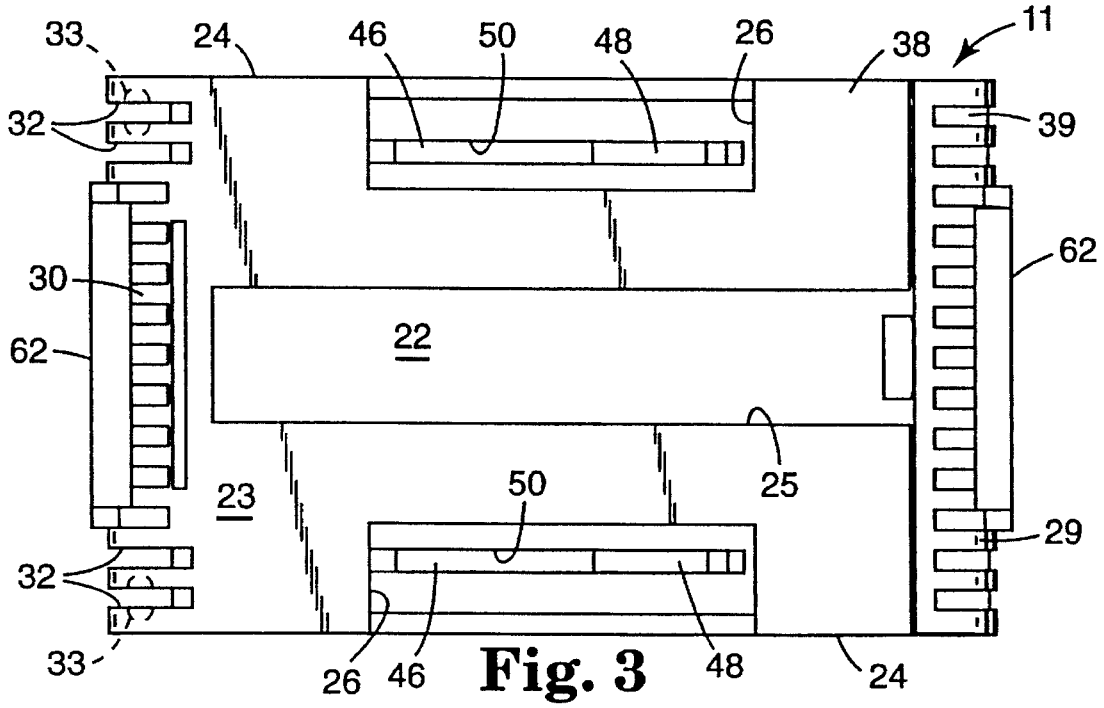
FIG. 3 is a top view of the dispenser.
Figure 8:
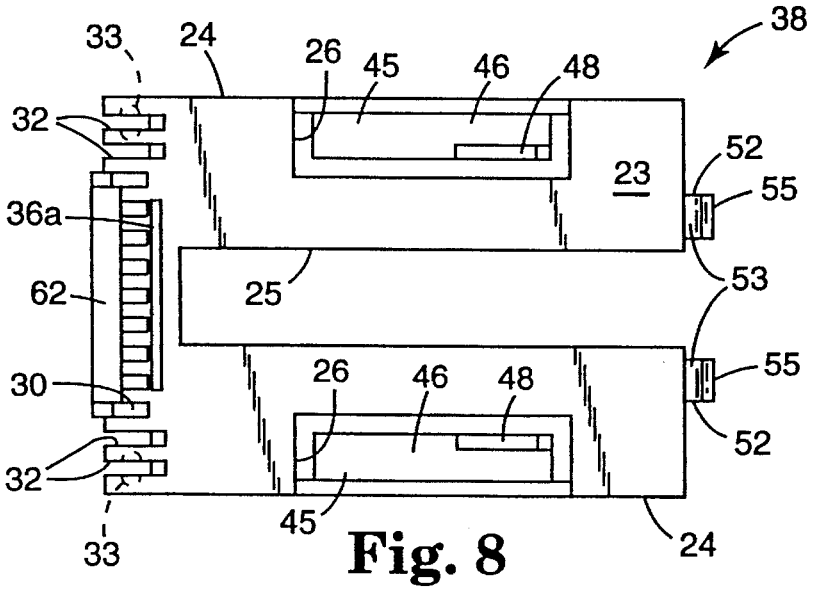
FIG. 8 is a top view of the first portion of the dispenser.
Figure 9:
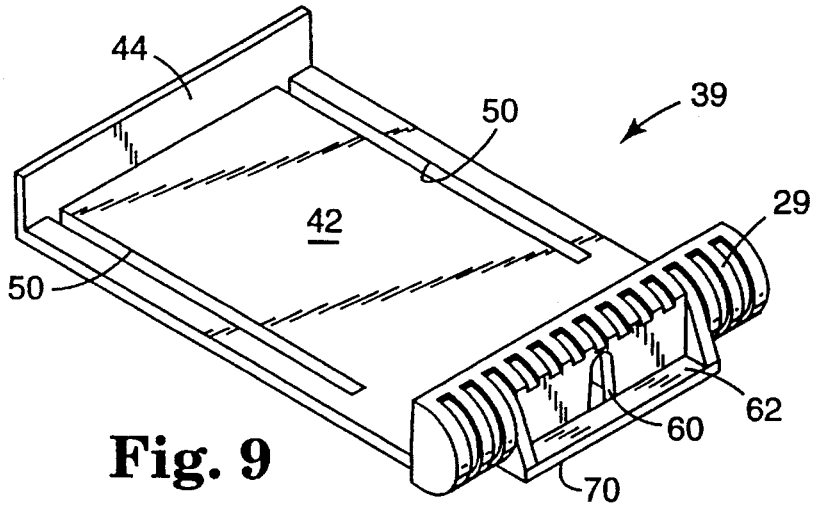
FIG. 9 is a perspective view of the second portion of the dispenser.

As is best seen in FIGS. 7, 8, and 9, the dispenser 11 comprises a first portion 38 (FIGS. 7 and 8) including the top wall 23, the side walls 24 and the second end wall 30; a second portion 39 (FIGS. 7 and 9) including the first end wall 29; means mounting the second portion 39 on the first portion 38 for movement between a closed position (FIGS. 1 through 5) with the first end wall 29 extending between the ends of the side walls 24 opposite the second end wall 30, and an open position (FIG. 7) with the first end wall 29 spaced from the ends of the end walls opposite the second end wall 30 to afford access to the cavity 22 to insert a stack of sheets therein; and means for releasably retaining the first and second portions 38 and 39 in the closed position.

As can best be seen in FIGS. 7 and 9, the second portion 39 of the dispenser 11 includes a tray-like projection from the first end wall 29 that includes a planar part defining a bottom wall 42 for the dispenser 11 that is spaced from its top wall 23, and a projection 44 from the end of the bottom wall 42 opposite the first end wall 29 that is adapted to nest along the second end wall 30 of the dispenser 11, with the spacing between the projection 44 and the first end wall 29 being adapted to receive the ends of the stack 16 of sheets 15 therebetween. The first portion 38 of the dispenser 11 includes opposed support rails 45 projecting inwardly from the edges of the side walls 24 opposite its top wall 23 (FIG. 8), which support rails 45 include generally planar portions 46 parallel to the top wall 23 and guide ribs 48 projecting upwardly from the planar portions 46 toward the top wall 23. The bottom wall 42 in the second portion 39 has surfaces defining spaced grooves 50 extending at right angles to the second end wall 30 that receive the guide ribs 48 with the surface of the bottom wall 42 opposite the top wall 23 supported on the planar portions 46, and engagement between the side surfaces of the guide ribs 48 and the surfaces defining the grooves 50 guide the first and second portions 38 and 39 during their relative movement between their open and closed positions.

Figure 4:
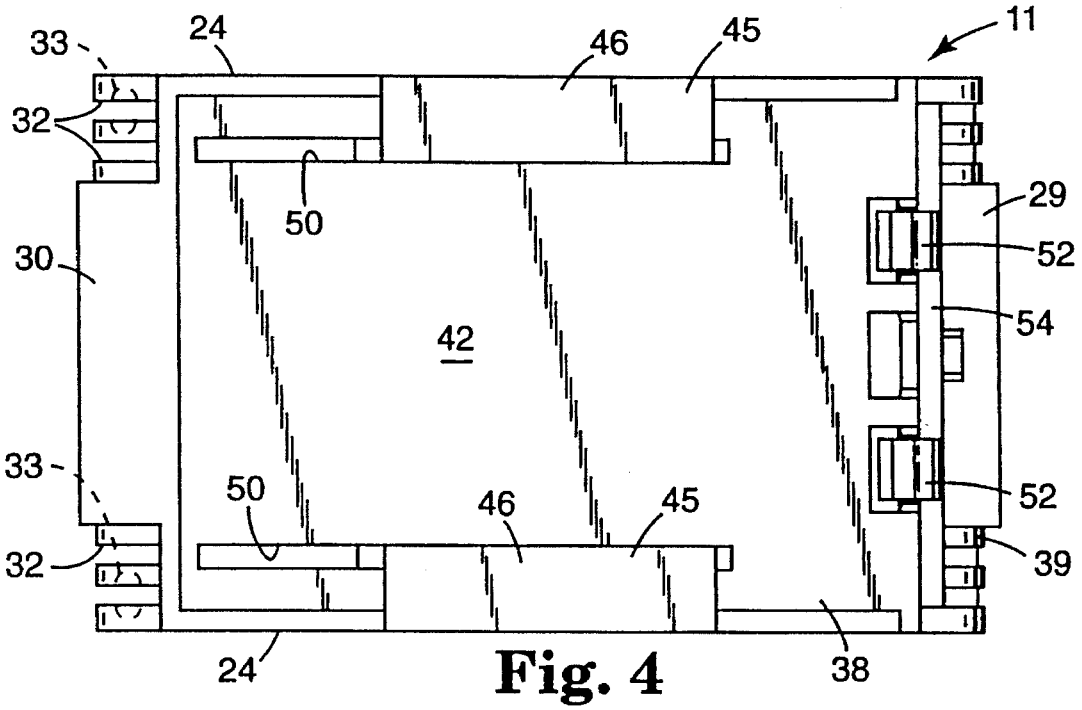
FIG. 4 is a bottom view of the dispenser.
Figure 5:
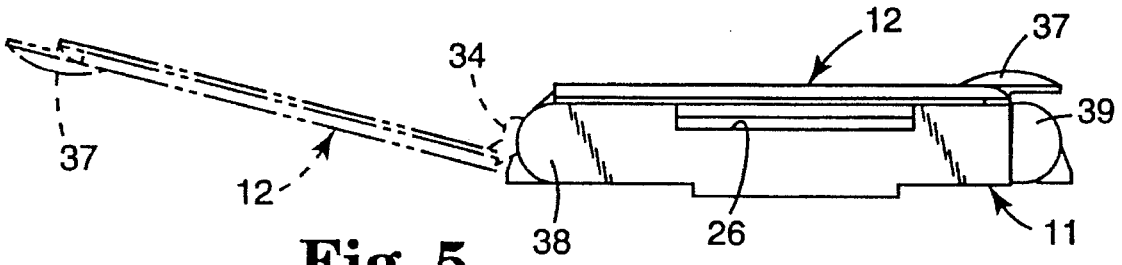
FIG. 5 is a side view of the dispenser showing a cover included in the assembly attached to the dispenser with the cover shown in solid outline in a closed position and shown in dotted outline in an open position.
Figure 6:
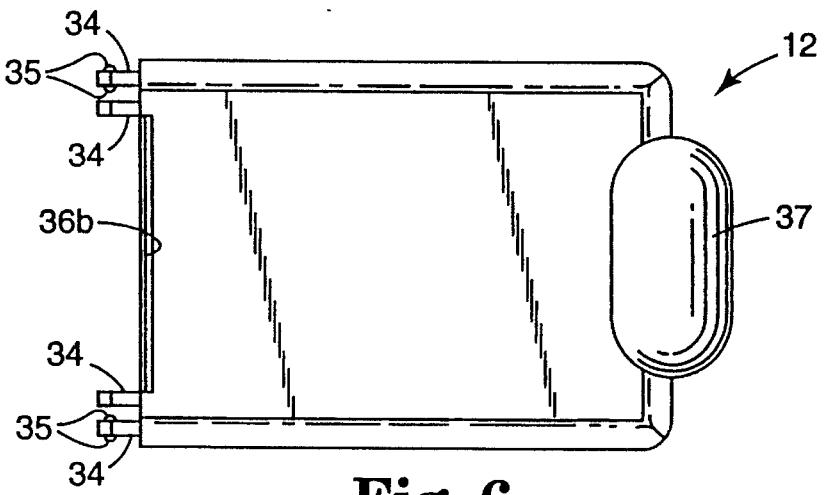
FIG. 6 is a top view of the cover included in the assembly of FIG. 1 and illustrated in FIG. 5.

The means for releasably retaining the first and second portions 38 and 39 of the dispenser 11 in the closed position is provided by spaced resiliently flexible tabs 52 projecting from the end of the top wall 23 adjacent the first end wall 29 (see FIGS. 4, 7 and 8). The tabs 52 have cupped upper surfaces 53 that, in the closed position of the first and second portions 38 and 39, are engaged around a lip 54 on the first end wall 29. When sufficient force is applied to move first and second portions 38 and 39 to their open position, the tabs 52 will deflect and thereby can be moved around that lip 54 on the first end wall 29. When the first and second portions 38 and 39 are again moved to their closed positions, cam surfaces 55 on the distal ends of the tabs 52 will engage the lip 54 on the first end wall 29 to deflect the tabs 52 and again allow them to move around the lip 54 on the first end wall 29. During such movement, lugs 56 projecting upwardly from the bottom wall 42 will engage within sockets in the first end wall 29 to provide the proper relationship between the first end wall 29 and the top wall 23 for such engagement of the tabs 52.

The removable attachment strap 13 for the dispenser 11 (see FIG. 1) is of a strong resiliently flexible polymeric material (e.g., nylon). The strap 13 has an elongate central portion 58 that has barbs 59 projecting from its opposite ends, which central portion 58 is normally generally straight. To engage the strap 13 with the dispenser 11, the strap 13 is bent into a loop with the barbs 59 adjacent, and the barbs 59 are inserted through an opening 60 in the first end wall 29, whereupon the spring tension in the central portion 58 will maintain the barbs 59 in engagement with the inner surface of the first end wall 29. The strap 13 can be used for various purposes, such as to attach the dispenser 11 to a structure such as in a notebook, or to hold keys, or to attach the dispenser 11 to a key ring.

The support member 14 and the dispenser 11 include means for releasably attaching the dispenser 11 to the support member 14 with the bottom wall 42 of the dispenser 11 along a front surface 61 of the support member 14. That means for releasably attaching the dispenser 11 to the support member 14 is provided by the dispenser 11 having opposite outwardly projecting ledges 62 centered along the first and second end walls 29 and 30 and disposed generally parallel with the bottom wall 42; and the support member 14 (see FIG. 1) including a ridge 64 projecting above the front surface 61 and defining a recess adapted to receive one of the ledges 62, and a latch portion 66 spaced along the front surface 61 from the ridge 64 and having a recess adapted to receive the other one of the ledges 62. The latch portion 66 is resiliently elastically bendable to a release position sufficiently spaced from the ridge 64 to afford movement of the ledges 62 into the recesses from a normal retaining position with the latch portion 66 in a position to releasably retain the ledges 62 in the recesses, and the latch portion 66 includes a manually engageable projection 68 affording manual movement of the latch portion 66 from the retaining position to the release position. Also, at least one (and preferably both) of the ledges 62 on the dispenser 11 and the latch portion 66 include cam surfaces 70 adapted for engagement with each other to move the latch portion 66 to its release position upon engagement of the other of the ledges 62 in the recess in the ridge 64 and movement of the one ledge 62 toward the recess in the latch portion 66. The support member 14 can be permanently mounted (e.g., by strips of adhesive) at a location where the dispenser 11 is normally used, such as against a horizontal or vertical surface in an office area. The dispenser 11 can then be supported on the support member 14 to afford ease of access to the sheets 15 therein, and can easily be removed from the support member 14 by manual manipulation of the latch portion 66 by the projection 68 to refill the dispenser 11 with a stack 16 of sheets 15, or if a person desires to take the dispenser 11 to a different location.

Figure 10:
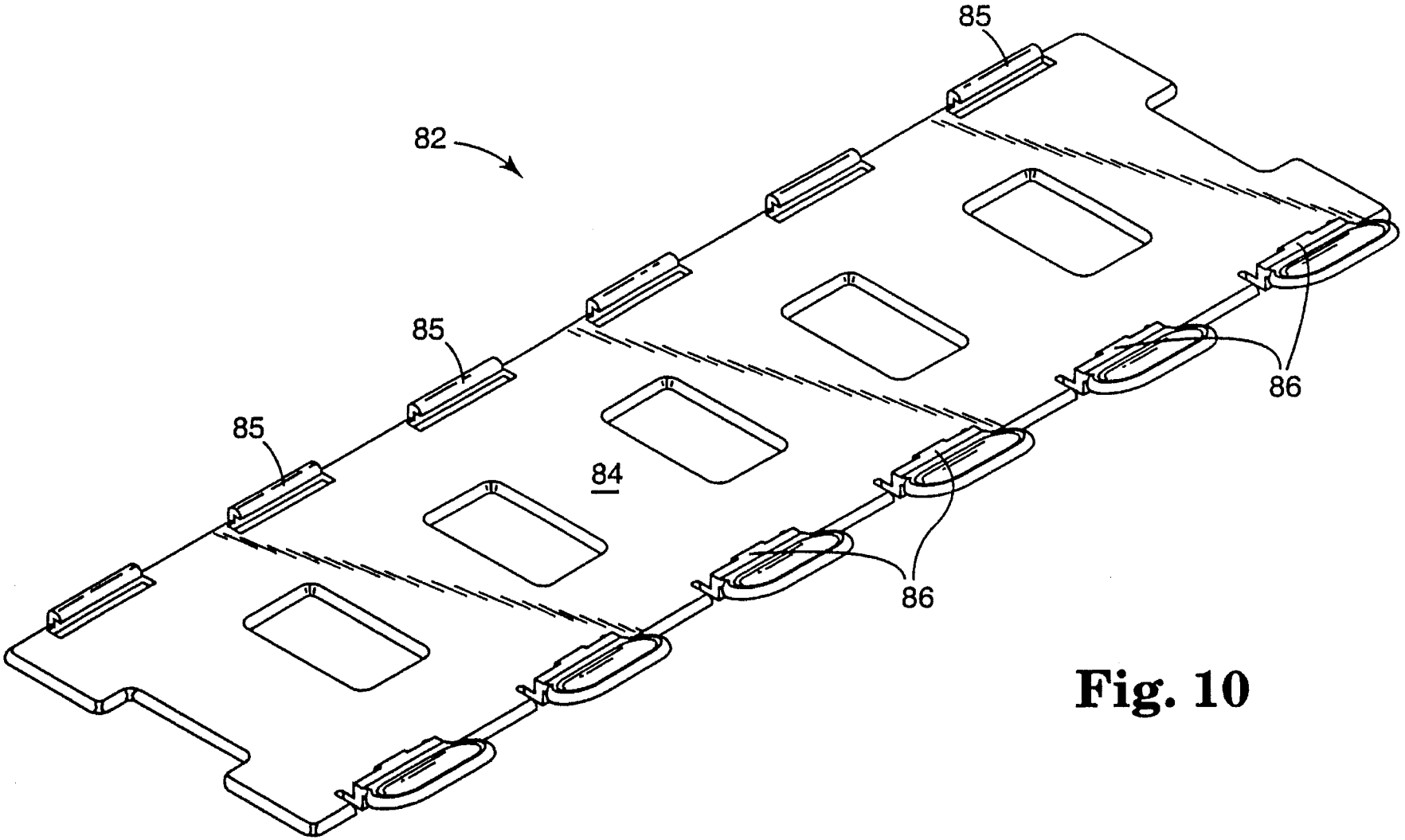
FIG. 10 is a perspective view of an alternative embodiment of a support member that can be included in the assembly according to the present invention.

An assembly according to the present invention can alternatively include a support member 82, such as is illustrated in FIG. 10, that includes attachment means capable of releasably attaching a plurality of the dispensers 11 to the support member 82 in side by side relationship with the bottom walls 42 of the dispensers 11 along a front surface 84 of the support member 82. That attachment means for each dispenser 11 includes a ridge 85 projecting above the front surface 84 and defining a recess adapted to receive one of the ledges 62, and a latch portion 86 spaced along the front surface 84 from the ridge 85 and having a recess adapted to receive the other one of the ledges 62, which ridges 85 and latch portions 86 have the same structures as the ridge 64 and the latch portion 66 described above for the support member 14. Those attachment means can also be used to releasably attach to the support member 82 the dispensing package for a product currently sold by Minnesota Mining and Manufacturing Company under the trade designation "Post-it" Brand Tape Flags which, when so attached, allows a user of the assembly 10 to either withdraw paper notes from one of the dispensers 11 attached to the support member 14, or to withdraw tape flags from one of those dispensers for tape flags.

The assembly according to the present invention has now been described with reference to two embodiments thereof. It will be apparent to those skilled in the art that many changes or additions can be made in the embodiments described without departing from the scope of the present invention. Thus, the scope of the present invention should not be limited to the structures described in this application, but only by structures described by the language of the claims and the equivalents of those structures.

We claim:

1. An assembly comprising:

a plurality of flexible sheets, said sheets each having first and second major surfaces, first and second opposite ends, and a band of pressure-sensitive adhesive on said second surface adjacent said second end of the sheet, the bands of adhesive on the sheets adhering the sheets to the first surfaces of adjacent sheets to form a stack and the bands of adhesive on successive sheets in the stack being at opposite sides of the stack, both said first and said second surfaces of each of the sheets being free from adhesive along a first end portion opposite the second end of the sheet; and a dispenser comprising walls having inner surfaces defining a cavity receiving the stack and having opposite outer surfaces, said walls including a top wall and opposite side walls, said side walls having opposite ends and depending from and flanking said top wall, said top wall being generally parallel with the sheets in the stack and having an outlet opening for said cavity between said inner and outer surfaces through which the first end portion of the uppermost sheet on the stack projects and through which individual sheets from the stack in the cavity may be manually withdrawn, which outlet opening is elongate in a direction parallel to said side walls, and said top and side walls having through access openings flanking said outlet opening, said access openings each being adapted to afford inspection of the number of sheets remaining in the dispenser and facilitating engagement of a person's finger with the first end portion of the sheet that projects through said outlet opening, lays along said outer surface of said top wall and overlays one of said access openings.

2. An assembly according to claim 1 wherein said dispenser further includes first and second end walls extending between the adjacent ends of said side walls, a cover adapted to overlay the outer surface of said top wall, and means mounting said cover on said second end wall for movement between a closed position overlaying the outer surface of said top wall with said cover generally parallel with the sheets in said stack, and an open position spaced from said top wall.

3. An assembly comprising:

a dispenser for flexible sheets from a stack of sheets disposed one on top of another, said dispenser comprising:

walls having inner surfaces defining a cavity adapted to receive the stack and having opposite outer surfaces, said walls including a top wall and opposite side walls, said side walls having opposite ends and depending from and flanking said top wall, said top wall having an outlet opening for said cavity between said inner and outer surfaces through which individual sheets from the stack in the cavity may be manually withdrawn, which outlet opening is elongate in a direction parallel to said side walls, and said top and side walls having through access openings flanking said outlet opening, said access openings each being adapted to afford inspection of the number of sheets remaining in the dispenser and to facilitate engagement of a person's finger with an end portion of one of the sheets that projects through said outlet opening, lays along said outer surface of said top wall and overlays one of said access openings;

said dispenser further including first and second end walls extending between the adjacent ends of said side walls, a cover adapted to overlay the outer surface of said top wall, and means mounting said cover on said second end wall for movement between a closed position overlaying the outer surface of said top wall, and an open position spaced from said top wall, said means mounting said cover on said second end wall for movement between said closed position and said open position includes means for detaching said cover from and subsequently re-attaching said cover to said second end wall only by manual application of separating and reattaching forces to said cover and said second end wall.

4. An assembly according to claim 3 wherein said means mounting said cover on said second end wall for movement between said closed position and said open position and said means for detaching said cover from and subsequently re-attaching said cover to said second end wall only by manual application of separating and reattaching forces to said cover and said second end wall are provided by spaced parts of the second end wall defining two pairs of spaced parallel grooves in said second end wall extending generally parallel to said side walls and defining a pair of generally semi-spherical opposed sockets recessed in said parts from the outer groove in each pair; and by said cover having two pairs of spaced parallel projecting plate-like portions spaced and adapted to be positioned in the grooves in the second end wall, and having generally semi-spherical projections projecting from opposite sides of the two outermost of the plate-like portions that are received in said sockets when the cover is engaged with the second end wall, whereupon said semi-spherical projections provide pivot members about which the cover can be moved between its open and closed positions, said spaced parts of the second end wall including a center plate like part partially defining each set of two grooves, which center plate like part is sufficiently resiliently flexible to allow said semi-spherical projections to be pulled from within the sockets when said cover is in said open position to detach the cover from said second end wall, and to subsequently afford repositioning of said semi-spherical projections within the sockets to re-attach said cover to said second end wall.

5. An assembly comprising:

a dispenser for flexible sheets from a stack of sheets disposed one on top of another, said dispenser comprising:

walls having inner surfaces defining a cavity adapted to receive the stack and having opposite outer surfaces, said walls including a top wall and opposite side walls, said side walls having opposite ends and depending from and flanking said top wall, said top wall having an outlet opening for said cavity between said inner and outer surfaces through which individual sheets from the stack in the cavity may be manually withdrawn, which outlet opening is elongate in a direction parallel to said side walls, and said top and side walls having through access openings flanking said outlet opening, said access openings each being adapted to afford inspection of the number of sheets remaining in the dispenser and to facilitate engagement of a person's finger with an end portion of one of the sheets that projects through said outlet opening, lays along said outer surface of said top wall and overlays said access opening;

said dispenser further including first and second end walls, and further comprising:

a first portion including said top wall, said side walls and said second end wall with said second end wall extending between adjacent ends of said side walls;

a second portion including said first end wall;

means mounting said second portion on said first portion for movement between a closed position with said first end wall extending between the ends of said side walls opposite said second end wall, and an open position with said first end wall spaced from the ends of said end walls opposite said second end wall to afford access to said cavity to insert a stack of sheets therein; and means for releasably retaining said first and second portions in said closed position.

6. An assembly comprising:

a dispenser for flexible sheets from a stack of sheets disposed one on top of another, said dispenser comprising:

walls having inner surfaces defining a cavity adapted to receive the stack and having opposite outer surfaces, said walls including a top wall and opposite side walls, said side walls having opposite ends and depending from and flanking said top wall, said top wall having an outlet opening for said cavity between said inner and outer surfaces through which individual sheets from the stack in the cavity may be manually withdrawn, which outlet opening is elongate in a direction parallel to said side walls, and said top and side walls having through access openings flanking said outlet opening, said access openings each being adapted to afford inspection of the number of sheets remaining in the dispenser and to facilitate engagement of a person's finger with an end portion of one of the sheets that projects through said outlet opening, lays along said outer surface of said top wall and overlays said access opening said dispenser further including first and second end walls extending between the adjacent ends of said side walls, and a bottom wall along the sides of said side and end walls opposite said top wall, and said assembly further includes a support member having a front surface, and means for releasably attaching said dispenser to said support member with the bottom wall of the dispenser along the front surface of said support member, said means for releasably attaching said dispenser to said support member being provided by said dispenser having opposite outwardly projecting ledges centered along said end walls and disposed generally parallel with said bottom wall, and said support member including a ridge projecting above said front surface and defining a recess adapted to receive one of said ledges, and a latch portion spaced along said front surface from said ridge and having a recess adapted to receive the other one of said ledges, said latch portion being resiliently elastically bendable to a release position sufficiently spaced from said ridge to afford movement of said ledges into said recesses from a normal retaining position with said latch member in a position to releasably retain said ledges in said recesses, and said latch portion including a manually engageable projection affording manual movement of said latch portion from said retaining position to said release position.

7. An assembly according to claim 6 wherein at least one of said ledges on said dispenser and said latch portion include cam surfaces adapted for engagement to move said latch portion to said release position upon engagement of the other of said ledges in the recess in said ridge and movement of said one ledge toward the recess in said latch portion.

8. An assembly according to claim 6 wherein said assembly includes a plurality of said dispensers, and said support member includes means for releasably attaching said dispensers to said support member in side by side relationship with the bottom walls of the dispensers along the front surface of said support member.

9. An assembly according to claim 8 wherein said means for releasably attaching said dispensers to said support member is provided by said dispensers each having opposite outwardly projecting ledges centered along said end walls and disposed generally parallel with said bottom wall, and said support member including a plurality of ridges projecting above said front surface and each defining a recess adapted to receive one of said ledges on one of said dispensers, and said support member further including a plurality of latch portions each spaced along said front surface from one of said ridges and having a recess adapted to receive the other one of said ledges on said one dispenser, said latch portions each being resiliently elastically bendable to a release position sufficiently spaced from said ridge to afford movement of said ledges into said recesses from a normal retaining position with said latch member positioned to releasably retain said ledges in said recesses, and said latch portions each including a manually engageable projection affording manual movement of said latch portion from said retaining position to said release position.

10. An assembly according to claim 9 wherein at least one of said ledges on each of said dispensers and each of said latch portions include cam surfaces adapted for engagement to move said latch portion to said release position upon engagement of the other of said ledges in the recess in said ridge opposite said latch portion and movent of said one ledge toward the recess in said latch portion.

11. An assembly according to claim 6 wherein said support member includes means for releasably attaching a plurality of dispensers similar to said dispenser to said support member in side by side relationship with the bottom walls of the dispensers along the front surface of said support member.

* * * * *